US006385405B1

(12) United States Patent
Kingsland

(10) Patent No.: US 6,385,405 B1
(45) Date of Patent: May 7, 2002

(54) METHOD AND APPARATUS FOR COMBINING XEROGRAPHIC AND INK JET PRINTING

(75) Inventor: David O. Kingsland, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/715,712

(22) Filed: Nov. 20, 2000

(51) Int. Cl.[7] ..... G03G 15/04
(52) U.S. Cl. ..... 399/2; 399/226
(58) Field of Search ..... 399/237, 226, 399/2, 239

(56) References Cited

U.S. PATENT DOCUMENTS 5,321,467 A 6/1994 Tanaka et al. ..... 355/202
5,612,777 A * 3/1997 Malhotra ..... 399/226
5,729,785 A 3/1998 Sakaizawa et al. ..... 399/2
5,835,814 A * 11/1998 Sawada ..... 399/4
5,847,738 A 12/1998 Tutt et al. ..... 347/101
6,122,471 A 9/2000 Liu et al. ..... 399/237
6,276,792 B1 * 8/2001 Gundlach et al. ..... 347/101

OTHER PUBLICATIONS

Gundlach et al., *Color Printing Apparatus And Processes Thereof*, Pending U.S. Patent Application Ser. No. 09/282,318, filed Mar. 31, 1999.

* cited by examiner

*Primary Examiner*—Quana M. Grainger
(74) *Attorney, Agent, or Firm*—David J. Arthur

(57) ABSTRACT

A method and apparatus for printing an image onto a medium such as paper incorporates elements of xerographic and direct marking printing technologies. A layer of colorless toner is applied to an intermediate surface, such as a charge receptor drum. The toner layer is compacted to reduce its porosity. Then, an ink image is applied to the toner layer, such as by ink jet printing. The toner layer including the embedded ink image is transferred from the charged receptor drum to a printing medium, such as paper. A fuser fixes the toner and embedded ink image onto the surface of the paper.

20 Claims, 2 Drawing Sheets

METHOD AND APPARATUS FOR COMBINING XEROGRAPHIC AND INK JET PRINTING

The present invention is directed toward the field of applying images to a medium such as paper. In particular, the invention relates to printers and methods of printing incorporating aspects of xerographic and ink jet printing technologies.

BACKGROUND OF THE INVENTION

Among the technologies available for applying an image to a medium, such as paper, are xerography and direct marking. Common forms of direct marking include ink pen and ink jet marking technologies.

Xerographic printing typically uses a dry toner and produces on a print medium a clear, durable image. However, those familiar with xerography will also recognize that the hardware required for xerographically printing images, and particularly for printing images in multiple colors, may be somewhat complex.

In conventional xerography, electrostatic latent images are formed on a xerographic surface by first uniformally charging a charge retentive surface such as a photoreceptor. The charged area is selectively dissipated in accordance with a pattern of activating radiation corresponding to the original image. The selective dissipation of the charge leaves a latent charge pattern on the imaging surface corresponding to the areas not exposed by radiation. This charged pattern is made visible by developing it with toner. Such development includes passing the photoreceptor past one or more developer housings. Color xerographic printing commonly requires multiple developers, generally three color developers (yellow, cyan, and magenta) plus a black developer. The developed image is then fixed to the imaging surface, or is transferred to a receiving medium such as paper, to which it is fixed by suitable fusing techniques.

Direct marking technologies, and in particular ink jet printing, have emerged as printing alternatives that incorporate relatively simpler hardware requirements. However, images produced with the inks used in ink jet marking technologies, and particularly in thermal ink jet marking technologies, do not always exhibit the same high level of clarity or permanence as xerographically produced images.

In direct marking technologies, ink in the desired image is applied directly to the print medium. Various techniques of direct marking are well understood in the art. For example, the image may be applied by direct contact between a pen and the medium. Alternatively, ink jet recording techniques eject droplets of ink from a printhead onto the medium. Such ink jet techniques may include thermal ink jets, acoustic ink jet, piezo-electric ink jet printing, and others.

Ink jet recording devices eject ink onto a print medium such as paper in controlled patterns of closely spaced dots. To form color images, multiple groupings of ink jets are used, with each group being supplied with ink of a different color from an associated ink container.

Referring particularly to thermal ink jet printing systems, such systems use thermal energy selectively produced by resistors located in capillary filled ink channels near channel terminating nozzles or orifices to vaporize momentarily the ink, and form bubbles on demand. Each temporary bubble expels an ink droplet and propels it toward a recording medium. The printing system may be incorporated in either a carriage type printer or a page width type printer. A carriage type printer generally has a relatively small printhead containing the ink channels and nozzles. The printhead is usually attached to an ink supply container, and the combined printhead and container form a carriage assembly that is reciprocated to print one swath of information at a time on a stationary recording medium. After the swath is printed, the paper is stepped in a distance equal to the height of the printed swath, so that the next printed swath will be contiguous. In contrast, a page width printer has a stationary printhead having a length equal to or greater than the width of the medium. The medium is continually moved past the page width printhead in a direction normal to the printhead length at a constant speed during the printing process.

SUMMARY OF THE INVENTION

The present invention is a method and apparatus for printing an image onto a medium incorporating a novel combination of aspects of both xerographic and direct marking print technologies.

In accordance with the method of the present invention, toner is applied to an intermediate element such as a charge receptor to form a toner layer on the intermediate element. A first ink image is then deposited onto the toner layer on the intermediate surface. The ink image and the toner layer are then transferred onto a print medium, and the ink image and the toner layer are fixed onto the medium.

The apparatus of the present invention is a printer that includes an intermediate surface, a developer for applying a toner layer to the intermediate surface, and a direct marking element for applying a first ink image to the toner layer on the intermediate surface. The printer further includes a transfer element for transferring the first image and the toner layer from the intermediate surface to a print medium.

DETAILED DESCRIPTION OF A PREFERRED EMBODIMENT OF THE INVENTION

The present invention combines aspects of xerographic and direct marking technologies to apply an image to a print medium, such as paper. One particular embodiment of a printer incorporating the present invention and for performing the method of the present invention is shown schematically in FIG. 1.

Figure 1:
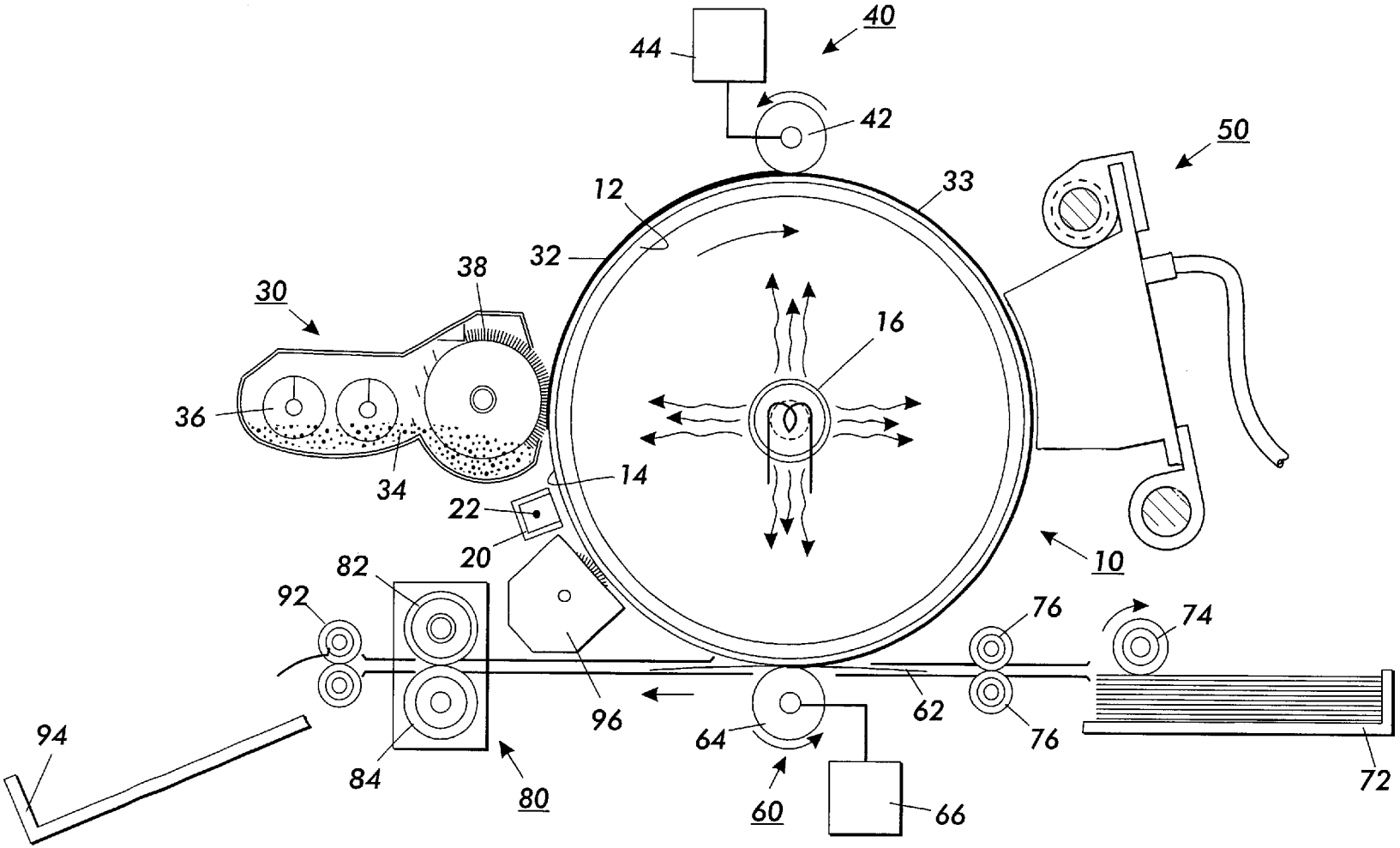
FIG. 1 is a schematic elevational view of an illustrative implementation of a printing apparatus incorporating the present invention.

Referring now to FIG. 1, the printer includes an intermediate element 10 for receiving a toner layer. The intermediate element may be a charge receptor, and in particular a cylindrical charge receptive drum. The charge receptive drum 10 includes a thermally conductive substrate 12 and a hard hydrophobic dielectric surface 14. A heater 16 may be included in the drum for heating the drum surface. The construction of such a charge receptor drum is well understood by those familiar with the xerographic printing arts. A rotator (not shown) rotates the drum so that the surface of the drum moves past each of the elements described below. Charge receptors other than a cylindrical drum may be used. For example, some applications may permit the use of a belt-type charge receptor.

A charging element 20 electrostatically charges the dielectric surface of the charge receptor drum. The charging element may be a corotron that includes a corona wire 22. In a preferred implementation, the corona uniformally charges the entire drum surface 14 in the image area with a positive charge. Other charging mechanisms can be used to charge the surface of the drum. For example, a dicorotron having a dicorotron wire can charge the drum surface with a positive charge or a negative charge. Alternatively, a scorotron can apply a negative charge to the surface of the drum. The following description assumes that a positive charge is applied to the surface of the drum.

A developer 30 applies a toner layer 32 to the drum surface 14. The toner is preferably a colorless toner. The toner includes a binder in the form of a clear resin or polymer, and may include optional charge control additives, optional surface additives, optional surfactants, and a lighffastness inducing agent. The developer 30 mixes toner with a carrier in a developer sump 34 by mechanical stirrers 36. The toner mixture has a negative charge so that the toner is attracted to and adheres to the positively charged drum surface 14. A magnetic brush 38 brings the toner mixture into proximity with the drum surface 14. Those familiar with the art will appreciate that other types of developers can be used to apply a layer of toner to the drum surface.

The developer 30 preferably applies a toner layer 32 having uniform thickness and density. The toner layer covers an area at least equal to, or slightly larger than, the area of the image to be printed. In a preferred implementation, the toner layer covers an area of the charge receptor drum that is equal to the area of the printing medium to which the image is to be applied.

A compactor 40 such as a pressure roller 42 compacts the toner layer 32 on the surface of the drum, to reduce the porosity of the toner, forming a compacted toner layer 33. The pressure roller 42 is preferably formed of an electrically conductive elastomer. A source of electrical bias 44 electrically biases the elastomer roller 42. Electrically biasing the pressure roller with the same type of charge applied to the drum surface minimizes any tendency of the toner 32 to transfer from the electrically charged drum surface 14 to the roller 42. For example, if the drum surface 14 is positively charged, the electrical bias source 44 should bias the elastomer roller 40 with a positive charge.

A direct marking element 50 applies an ink image directly to the compacted toner layer 33 on the drum surface 14. Non-contacting ink jet marking technologies are preferred for applying the ink image to the compacted toner layer. Exemplary ink jet printing technologies include thermal ink jet, acoustic ink jet, and piezo ink jet. Other types of direct marking technologies may be appropriate in certain applications.

Figure 2:
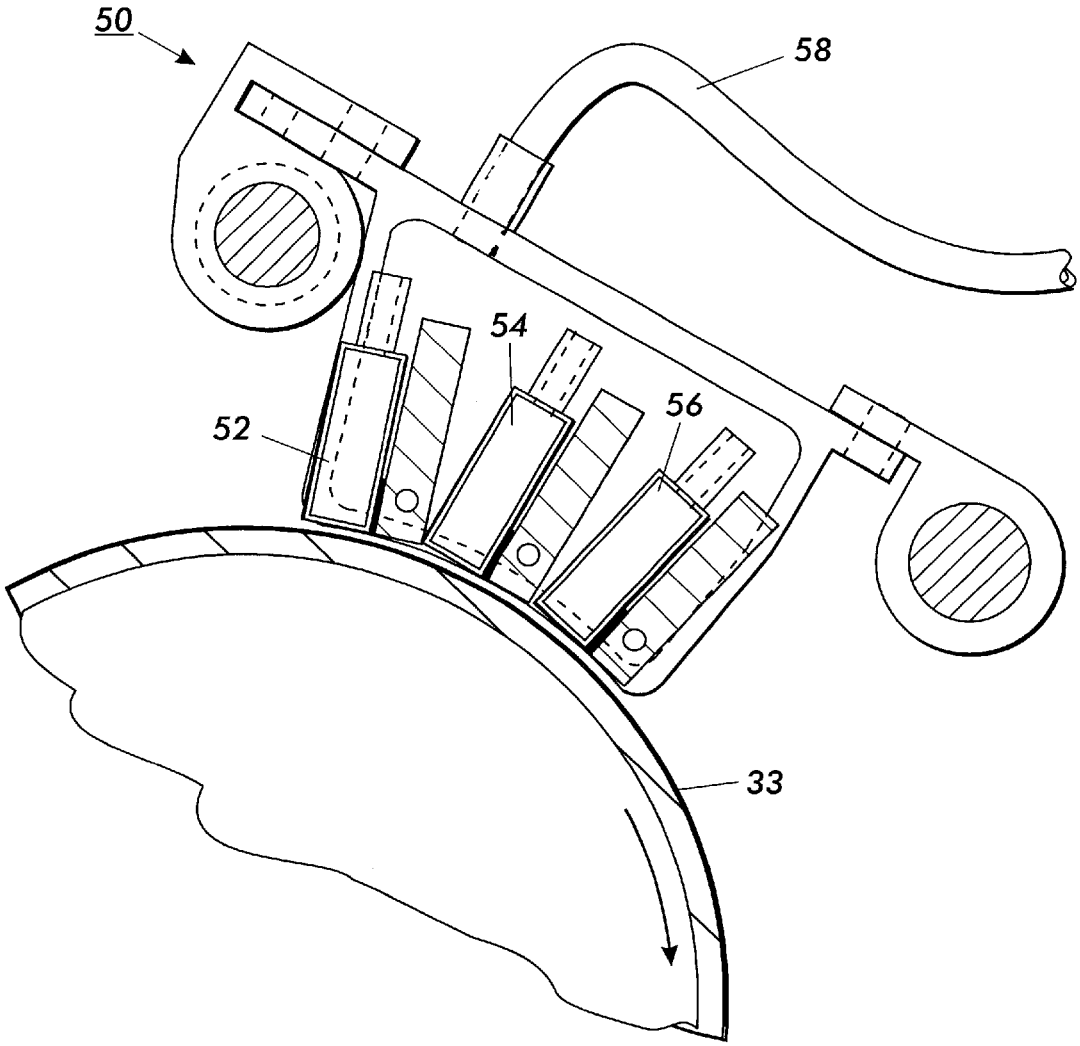
FIG. 2 is a schematic view of a particular implementation of the direct marking element of a printer incorporating the present invention.

In accordance with the embodiment illustrated, thermal ink jet printing is used to apply the ink image to the compacted toner layer. Referring now to FIG. 2, an exemplary ink jet printing apparatus including three printheads 52, 54, 56 is shown conceptually. Different types of ink jet printheads will be apparent to those familiar with the ink jet arts. Each printhead 52, 54, and 56 may apply a different color, such as yellow, Cyan, and Magenta. A separate black printhead (not shown) may also be included. As will be understood by those skilled in the art, combining these colors allows a wide range of colors to be applied by the ink jet printer. Each printhead is capable of depositing a controlled pattern of closely spaced dots. Together the patterns of dots deposited by the printhead form the ink image. Each printhead is supplied with ink from an ink reservoir which may be an ink tank on the printhead. The tank on the printhead may be replaceable, or may in turn be supplied through a conduit 58 from a remote ink source (not shown).

Although a three printhead/three color embodiment is illustrated, numerous other arrangements may be used. For example, a six printhead arrangement may be used to deposit either three colors or six colors. Furthermore, if only single color (monochromatic) images are to be printed, the direct marking element may include only a single printhead, or multiple printheads that all deposit ink of the same color.

Certain ink jet printer technologies, and particularly thermal ink jet printers, use water based inks. The heater 16 on the charge receptor drum 10 can be used to heat the surface 14 of the drum. The heated drum surface causes the water in the ink to quickly evaporate, leaving only the pigment or the dye from the ink. This rapid evaporation reduces any tendency of the ink to disperse within the toner layer, producing a sharp image with minimal intercolor bleed. The result of the ink printing step is that the compacted toner layer 33 has the ink image embedded in it. The ink used in the ink print element is electrically non-conducting, so that it does not interfere with the subsequent transfer of the toner layer with the embedded ink image onto the printed medium.

A transfer element 60 transfers the toner layer with its embedded ink image from the charge receptor drum 10 onto a print medium 62, such as a sheet of paper. The transfer element includes a transfer roller 64 for pressing the medium 62 against the surface of the drum. Preferably, the transfer roller 64 is formed of an electrically conductive elastomer. An electrical bias source 66 electrically biases the roller 64, which in turn charges the medium 62, to encourage transfer of the toner layer with the embedded ink image from the drum surface onto the medium. The print medium 62 is charged so that the electrostatic attraction between the toner 32 and the medium 62 is stronger than the electrostatic attraction between the toner and the charge receptor surface 14. In most applications, applying a positive charge to the medium 62 is advantageous, regardless of whether the charge receptor 14 has been charged positively or negatively.

In some applications, the print medium may be passed by a transfer corotron (not shown) to apply a charge to the medium before it encounters the transfer element 60. Those familiar with the xerographic printing arts will be familiar with such transfer corotrons.

In addition, a pretransfer station (not shown) may be positioned adjacent the drum 10 before the transfer element 60 to loosen the attraction between the toner layer 32 and the drum surface 14. Such pretransfer stations are known to those familiar with the xerographic printing arts.

As noted above, the print medium 62 may be paper, including advantageously plain paper. In the illustrated embodiment, the paper is stored in paper tray 72. A feed roller 74 draws a sheet of paper from the tray. Transport rollers 76 move the sheet of paper to the transfer element 60, and align the paper between the drum surface 14 and the transfer roller 64. As will be understood by those familiar with the art, the paper 62 must be exactly registered with the drum so that after the toner layer with the embedded image is transferred to the paper, the image is properly positioned on the paper. Other print media may also be used, including clear transparencies, vinyl sheets, transfer media, etc. In addition, the print media may be in the form of long strips from a roll, rather than individual sheets.

A stripping mechanism (not shown) may be positioned adjacent the transfer element 60 to assist in lifting the print medium from the surface of the charge receptor. The stripping mechanism may be advantageous in circumstances in which after application of the transfer roller, the print medium 64 tends to stick to the charge receptor surface.

A fuser 80 fixes the toner layer with the embedded image onto the surface of the print medium 62. The fuser may be of the type conventionally used with xerographic printers. For example, the fuser may include a fuser roller 82 and a pressure roller 84. The fuser roller may be heated to melt the toner, while the pressure roller 84 presses the print medium against the fuser roller. The fuser roller may also be unheated. Those familiar with the xerographic printing arts will recognize that radiant fusing may also be used. Radiant fusing systems use intense light, such as a quartz rod to melt the toner and fuse it with the fibers of the paper. Those skilled in the art will also recognize that other fusing mechanisms used in the xerographic printing art may also be used for the fuser of the embodiment illustrated. Toner softens (or melts) at temperatures above the boiling point of water (a frequent carrier in inks). Therefore, the ink image will not tend to spread during the fusing process.

The print medium 62 with the fused toner including the embedded image is then transferred by output transport rollers 92 to an output element, such as an output tray 94.

The ink image applied by the direct marking element 50 onto the toner layer 32 on the surface of the drum and then transferred to the paper 62 is thoroughly dried by the time the paper is placed in the output element, such as the output tray 94. Therefore, it is not necessary to wait for the ink on a sheet of paper in the output tray to dry before placing the next sheet of paper in the output tray. This allows faster output than is sometimes possible with certain ink jet printing devices. Furthermore, because the image transferred to the paper is a dry image, cockle (the tendency of paper to warp when aqueous ink is applied) is minimized or eliminated. With cockle virtually eliminated, paper can be stacked consistently, and thus the output element may include finishers, such as stackers, staplers, folders, and other elements common in xerographic printing devices.

Finally, after fusing, the toner seals the ink image to the paper, improving the colorfastness of the image over that available with conventional ink jet printing technologies, and also reducing the tendency of the ink image to smear if it is exposed to water or a damp environment.

A cleaning station 96 prepares the charge receptor surface for the next image cycle. The cleaning station 96 removes residual toner from the drum surface 14, and electrically neutralizes the drum. These actions help to ensure that the drum surface 14 is ready to receive an even layer of toner for the next image cycle. Such cleaning stations are well known in the xerographic printing arts.

Those skilled in the art will recognize that, taking the teachings of the above particular embodiment, modifications may be made to the embodiment described above without departing from the scope of the appended claims. For example, other types of surfaces may be used to receive the toner layer, particularly other types of charge receptors. In addition, other types of direct marking techniques may be used in lieu of thermal ink jet. In addition, various modifications or variations may be made to the developer for applying the toner layer, for compacting the toner layer, and for transferring the toner layer with embedded image to the medium. Therefore, the scope of the following claims is not limited to the specific embodiment described above.

What is claimed:

1. A method of printing an image onto a medium, the method comprising:

applying toner to the surface of an intermediate element to form a toner layer on the intermediate element surface;

depositing a first ink image onto the toner layer on the intermediate element surface;

transferring the ink image and the toner layer onto a medium; and fixing the ink image and the toner layer on the medium.

2. The method of claim 1, additionally comprising the step of electrostatically charging the intermediate element surface prior to applying the toner.

3. The method of claim 1, wherein the toner is colorless.

4. The method of claim 1, wherein the step of applying the toner to the intermediate element surface comprises applying a uniform layer of toner across the intermediate element surface.

5. The method of claim 1, wherein the step of applying the toner to the intermediate element surface comprises applying a toner over a portion of the intermediate element surface.

6. The method of claim 5, wherein the step of applying a toner layer over a portion of the intermediate element surface comprises applying toner over that portion of the intermediate element surface upon which the first image is to be applied.

7. The method of claim 1, additionally comprising, after the step of applying the toner to the intermediate element surface, the step of reducing the porosity of the toner layer on the intermediate element surface.

8. The method of claim 1, additionally comprising, after the step of applying the toner to the intermediate element surface, the step of compacting the toner layer on the intermediate element surface.

9. The method of claim 8, wherein the step of compacting the toner layer comprises applying a pressure roller to the toner layer on the intermediate element surface, and the process additionally comprises the step of electrically biasing the pressure roller.

10. The method of claim 1, wherein the step of depositing a first ink image onto the toner layer comprises jetting ink onto the toner layer.

11. The method of claim 10, additionally comprising the step of heating the intermediate element surface.

12. The method of claim 11, wherein the step of jetting ink onto the toner layer comprises jetting an electrically non-conducting ink onto the toner layer.

13. A printer comprising:

an intermediate surface;

a developer for applying a toner layer to the intermediate surface;

a direct marking element for applying a first ink image to the toner layer on the intermediate surface; and a transfer element for transferring the first image and the toner layer from the intermediate surface to a medium.

14. The printer of claim 13, wherein the direct marking element comprises an ink jet printhead and an ink source containing ink.

15. The printer of claim 14, wherein:

the ink in the ink source is an aqueous ink;

the intermediate surface comprises a thermally conductive substrate and a hydrophobic dielectric surface; and the printer additionally comprises a heater connected to the intermediate surface.

16. The printer of claim 15, wherein the transfer element comprises a transfer roller for pressing the medium against the intermediate surface having the ink image and the toner layer, and the printer additionally comprises a source of electric bias connected to the transfer roller.

17. The printer of claim 16, additionally comprising a compactor for reducing the porosity of the toner layer on the intermediate surface before the direct marking printhead applies the first image.

18. The printer of claim 17, wherein the pressure element comprises a roller for compressing the toner layer on the intermediate surface, and the printer additionally comprises a source of electric bias connected to the pressure roller.

19. The printer of claim 18, wherein the pressure roller is formed of an electrically conductive elastomer.

20. A printer comprising:

a charge receptor drum having a thermally conductive substrate and a hydrophobic dielectric drum surface;

a charging element for electrostatically charging the drum surface;

a heater connected to the drum to heat the drum surface;

a developer for applying a toner layer to the drum surface;

an electrically biased pressure roller to compress the toner layer on the drum surface;

an ink jet printhead for jetting ink onto the toner layer to form a first ink image on the toner layer on the drum surface;

an electrically biased transfer roller for pressing a medium against the intermediate surface to transfer the first image and the toner layer from the intermediate surface to a medium; and a fuser for fixing the first ink image and the toner layer to the medium.

* * * * *